US011717856B2

(12) United States Patent
Ferreira Dos Santos et al.

(10) Patent No.: US 11,717,856 B2
(45) Date of Patent: Aug. 8, 2023

(54) MINING SCREEN, SCREEN PANEL APPLIED ON MINING SCREEN, MINING SYSTEM, AND CONTROL METHOD FOR MINING SCREEN

(71) Applicant: Blue Ocean Engenharia Ltda, Barueri (BR)

(72) Inventors: Eduardo Ferreira Dos Santos, Barueri (BR); Eduardo Demetrio Leal, Sao Jose dos Campos (BR)

(73) Assignee: Blue Ocean Engenharia Ltda, Barueri (BR)

( * ) Notice: Subject to any disclaimer, the term of this patent is extended or adjusted under 35 U.S.C. 154(b) by 0 days.

(21) Appl. No.: 17/042,123

(22) PCT Filed: Mar. 26, 2019

(86) PCT No.: PCT/BR2019/050101
§ 371 (c)(1),
(2) Date: Sep. 26, 2020

(87) PCT Pub. No.: WO2019/183697
PCT Pub. Date: Oct. 3, 2019

(65) Prior Publication Data

US 2021/0016322 A1 Jan. 21, 2021

(30) Foreign Application Priority Data

Mar. 27, 2018 (BR) ..... 102018006222-0

(51) Int. Cl.
*B07B 1/46* (2006.01)
*B07B 1/36* (2006.01)
*B07B 1/42* (2006.01)

(52) U.S. Cl.
CPC ..... *B07B 1/469* (2013.01); *B07B 1/36* (2013.01); *B07B 1/42* (2013.01)

(58) Field of Classification Search
CPC .. B07B 1/36; B07B 1/42; B07B 1/469; B07B 1/4609; B07B 1/4618; B07B 1/4636
See application file for complete search history.

(56) References Cited

U.S. PATENT DOCUMENTS 4,519,902 A * 5/1985 Kinder ..... B01D 35/20 209/244
4,977,575 A * 12/1990 Ortiz ..... H01S 3/106 372/103

(Continued)

FOREIGN PATENT DOCUMENTS

DE 36 11 234 C1 10/1987
DE 202 11 860 U1 9/2003

(Continued)

OTHER PUBLICATIONS

International Search Report (with English translation) dated Dec. 2, 2019 for International Application No. PCT/BR2019/050101.

(Continued)

*Primary Examiner* — Joseph C Rodriguez
(74) *Attorney, Agent, or Firm* — Lippes Mathias LLP

(57) ABSTRACT

It is described a mining screen (100) comprising at least one propulsion element (140) associated with a screening structure (165), wherein the mining screen (100) is able to carry out (develop) at least one vibration regime, thereby promoting the screening of a material moving through the screen (100), wherein the screen (100) is configured in such a way that at least one between the propulsion element (140) and the screening structure (165) are manufactured from a first material, the first material configured as a compound (composite) material. Furthermore, it is described as a screen panel (156) applied on a mining screen (100), a control method for mining screen as well as a mining system.

14 Claims, 17 Drawing Sheets

(56) References Cited

U.S. PATENT DOCUMENTS

| | | | | |
|---|---|---|---|---|
| 5,232,099 | A * | 8/1993 | Maynard | B07B 1/42 209/276 |
| 5,589,015 | A | 12/1996 | Fusco et al. | |
| 6,346,319 | B1 * | 2/2002 | Cochran | C08J 5/046 428/295.7 |
| 6,845,868 | B1 | 1/2005 | Krush et al. | |
| 9,586,235 | B2 * | 3/2017 | Zhao | B07B 1/42 |
| 10,894,846 | B2 * | 1/2021 | Pan | C08F 220/06 |
| 2005/0199845 | A1 | 9/2005 | Jones et al. | |
| 2006/0016768 | A1 * | 1/2006 | Grichar | B07B 1/4618 210/780 |
| 2007/0108107 | A1 | 5/2007 | Morrow | |
| 2008/0272615 | A1 * | 11/2008 | McKnight | F15D 1/10 296/180.5 |
| 2008/0314804 | A1 * | 12/2008 | Wojciechowski | B07B 1/46 209/233 |
| 2012/0186819 | A1 * | 7/2012 | Dagenais | E21B 43/108 166/381 |
| 2014/0166307 | A1 | 6/2014 | Cady | |
| 2015/0361308 | A1 | 12/2015 | Rezai et al. | |
| 2017/0056928 | A1 | 3/2017 | Torrione | |
| 2020/0246833 | A1 * | 8/2020 | Wojciechowski | B01D 29/05 |
| 2021/0339499 | A1 * | 11/2021 | Mencattelli | B32B 5/024 |
| 2021/0401440 | A1 * | 12/2021 | Connor | A61B 17/12113 |

FOREIGN PATENT DOCUMENTS

| | | | |
|---|---|---|---|
| DE | 10 2014 106 756 | A1 | 11/2015 |
| GB | 2 082 090 | A | 3/1982 |
| GB | 2 086 254 | A | 5/1982 |
| JP | 2017213531 | A * | 12/2017 |
| WO | WO 00/58031 | | 10/2000 |
| WO | WO 2008/141373 | A1 | 11/2008 |

OTHER PUBLICATIONS

Written Opinion of the International Searching Authority dated Dec. 2, 2019 for International Application No. PCT/BR2019/050101.

* cited by examiner

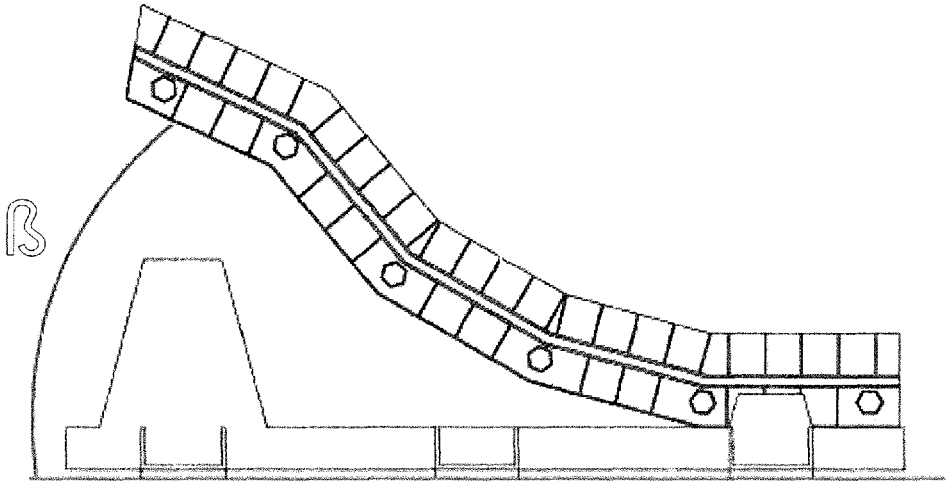
FIG. 14 (a)
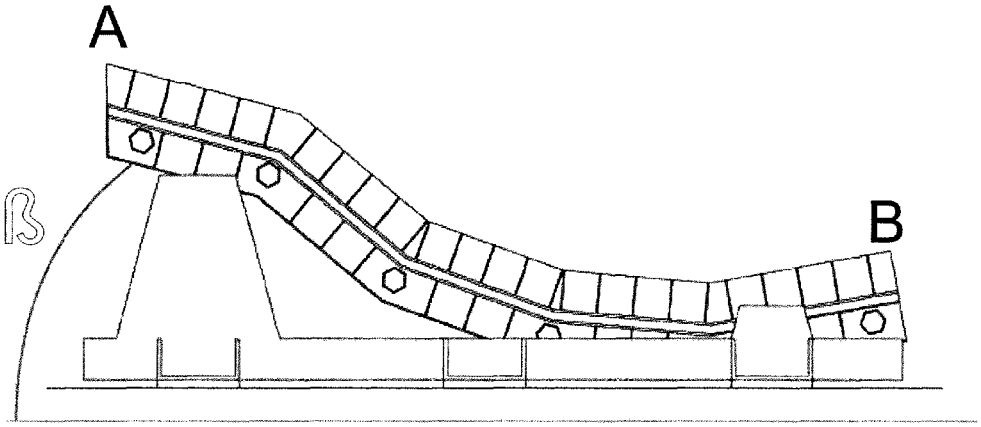
FIG. 14 (b)
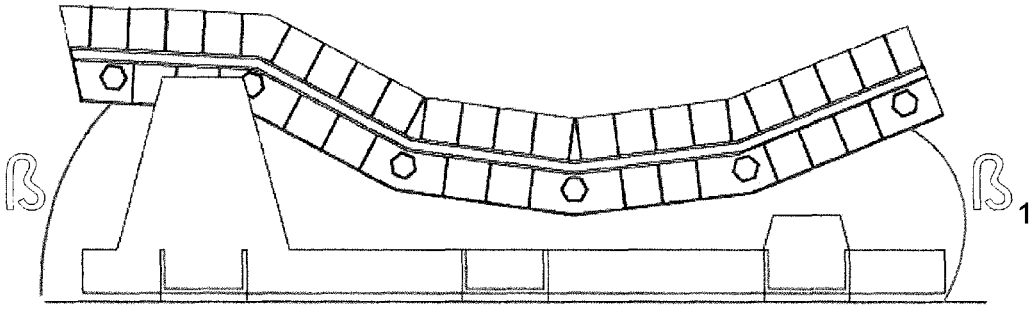
FIG. 14 (c)
FIG. 14

MINING SCREEN, SCREEN PANEL APPLIED ON MINING SCREEN, MINING SYSTEM, AND CONTROL METHOD FOR MINING SCREEN

The present application regards equipment capable of performing the separation and classification of various materials and elements. More specifically, to a screen comprising components configured to provide different types of movements in different positions, such as a vibratory movement for materials separation through a surface with orifices that enable the present invention to perform, for instance, stratification processes, separation by classification, scalp, and dewatering of various materials.

DESCRIPTION OF THE PRIOR ART

A separation process is a process that allows to separate components of a mixture, be it in small scale as in laboratories or large scale as in mining.

Sorting, for example, is a kind of mixture separation made manually of the solid/solid type. The substances are separated manually, with tweezers, spoon, or another auxiliary object. It is beans, with woodworms and stones. It is also used for waste recycling, with the separation of the different materials that compose it, such as glass, metal, rubber, paper, plastic, allocated in different recycling plants.

Mining processing consists of a series of processes that aim at the physical separation of useful minerals from the gangue, (gangue which must be understood as the ore part that has no economic value) until the final obtainment of a concentrate with a high content of useful minerals.

The used methods may be physical or chemical and can be divided into an approximately sequential form:

1—Primary fragmentation;

2—Granulation;

3—Grinding;

4—Classification (may be included between the various types of fragmentation and concentration); and 5—Concentration.

The obtained product in the final stage of concentration is the final product of the mining activity, sold for an established price according to the content of metal that contains it.

There are different types of separators, classifiers, and screens, whether static or vibrational. The most common types in this environment have as main activities the accomplishment of pre-classification, classification, reject, washing and dewatering, being of linear, circular or elliptical movement.

This type of machinery has several deficiencies among which we can highlight, among others, the following.

Initially, it is emphasized that the composition of the machine elements is predominantly metallic, with a consequently very high number of welds.

For a machine of this procedure and with the aforementioned applications, i.e., with high frequencies of operation vibration at raw materials separation originated from mining activities, it proves to be quite ineffective and dangerous the presence of welds as the known machines demonstrate today in the prior art.

In addition to the welds, also rivets, bolts and nuts are widely used which, due to the screen vibration, loosen quickly affecting the whole screen structure and thus altering its mechanical and physical characteristics throughout the time in which they are put into operation, thus entering the structure resonance bands due to both mass and rigidity loss.

Moreover, these machines operate on springs and behave therefore as a spring-mass system and in this case, also presenting high levels of fatigue due to operation type and hostile environment in which it operates.

Besides, known machines are difficult to reconfigure in different operating scenarios, taking days to be reconfigured if necessary.

Therefore, in the configurations in which the known machines are present in the prior art, the rate of collapses is high due to resonance in various parts of their structures, due to the structural characteristics thereof.

More specifically, the current technology regarding mining screens configuration has come very close, or even in the totality, from its productive and sustainable limits regarding the structural requirements.

More specifically, during regime operation of a known screen in the prior art, it is possible to observe that the machine presents erratic behaviors during the screening, which connotes characteristics of equipment working in resonance, or natural frequencies, caused by premature fatigue or structural limitations. These events can easily cause even greater damage, such as the total collapse of the aforementioned equipment.

Therefore, the equipment presents screening instability, further describing random shapes in the material traffic on the screening deck, these features inevitably are going to cause the vibrational imbalance of the assembly, causing overload only on one equipment side and increasing unexpectedly the material layer height, which obviously tends to be detrimental to the screen operation.

These phenomena are inevitably caused by the natural frequencies of the assembly, where the forces and magnitudes are maximized as a consequence of the working frequency to be coincident to the critical structural frequencies, therefore causing premature failures of the equipment, excessive vibration and may even lead to total collapse and accidents of great magnitude.

In this scenario, the known types of equipment in the prior art break very often for working too close or inside the structures resonant frequencies, this fact ultimately generates great physical unavailability for sites in which they operate, still generating the need to conduct frequent maintenance as well as causing constant breaks in production and thus resulting in losses of major proportions.

In summary, it was found that the manufacturing of screens currently known in the prior art for metallic material entails the existence of resonance frequencies in extremely low ranges, such as from 5 to 30 Hz, so that the screen operating frequency tends to coincide with such resonant frequencies.

In other words, the currently known types of equipment operate exactly in the critical range of frequency, that is, the chance of accidents due to operation in resonance is immense, and the occurrence of serious accidents are considered as a matter of time.

Therefore, from the change in the manufacturing material of the screen, the present invention has raised the range of structural frequencies of the screen beyond the operating frequency thereof.

From the teachings of the present invention, the structural frequencies range of the screen was raised to levels far from the operating frequency thereof.

In summary, the main limiting factors in the known types of equipment would be its materials constructive characteristics, equipment with high weld and fastener indexes, their weights and their natural frequencies versus ideal working frequencies. As aforementioned, such characteristics tend to impair the correct equipment operation.

The present invention seeks to overcome the problems known in the prior art by proposing a mining screen that is made of composite material (composite), thus ensuring greater mechanical strength and reduced weight.

Besides, in the present invention proposed screen, the natural frequencies of the resonance bands have been eliminated, which allows for greater flexibility and constructive conditions, allowing the use of motion (vibration) propellers differentiated from the current concepts.

Additionally, due to the drastic changes in assembling and regarding the screens manufacture material, enabled the appliance of motion/vibrations propellers different from current concepts for its significant reduction in mass (weight) making them completely intelligent structures and capable of activation by hydraulic, electromechanical, pneumatic and/or magnetic propulsion systems, which were not feasible or possible in the known concepts of the prior art.

More specifically, there are no mining screens in the prior art made from composite materials (composite) which present resonant frequencies quite different from the vibration frequency in which they operate and which enable the flexibility of operating conditions, so that they can be easily adapted with new characteristics and also have intelligent structures that monitor machine parameters.

OBJECTIVES OF THE INVENTION

A first objective of the present invention is to provide a mining screen.

A second objective of the present invention is to provide a mining screen made from a first material, wherein the first material is configured as a compound (composite) material.

A third objective of the present invention is to provide a mining screen manufactured from at least one of the following materials: carbon fiber, glass fiber, kevlar, graphene, rohacell, and aluminum fiber.

A fourth objective of the present invention is to provide a mining screen possessing a screen panel, wherein the screen panel comprises apertures of variable dimensions.

A further objective of the present invention is to provide a mining screen possessing a hydraulic system, wherein the hydraulic system comprises independently driven cylinders.

The present invention also has as its objective the provision of a screen panel utilized in a mining screen, wherein the screen panel comprises apertures of variable dimensions.

An additional objective of the present invention resides in the provision of a screen panel used in a mining screen, wherein this panel screen is formed of at least a first material and a polymeric material, wherein the first material refers to at least one between carbon fiber, fiberglass, kevlar, graphene, rohacell, and aluminum fiber.

The present invention also has as its objective the provision of a controlling method for a mining screen.

The present invention also has as its objective the provision of a mining system that utilizes the screen and/or the screen panel proposed in the present invention.

BRIEF DESCRIPTION OF INVENTION

The objectives of the present invention are achieved through a mining screen comprising at least one propulsion element associated with a screening structure, wherein the mining screen is able to carry out (develop) at least one vibration regime, promoting therefore the screening a material moving through the screen, wherein the screen is configured so that at least one of the propulsion element and the screening structure are manufactured from a first material, and the first material configured as a compound (composite) material.

Furthermore, it is proposed a screen panel applied in a mining screen, wherein the screen panel is capable of performing at least one vibration regime, thereby promoting material screening through a plurality of apertures arranged on the screen panel, wherein the screen panel is configured so that their apertures present variable dimension.

It is also described a screen panel applied on a mining screen, in which the panel screen can carry out (develop) at least one vibration regime, thus promoting the material screening through a plurality of apertures arranged on the panel screen, wherein the panel screen is composed of at least one first material, and a polymeric material, wherein the first material refers to at least one of carbon fiber, glass fiber, kevlar, graphene, rohacell, and aluminum fiber.

The objectives of the present invention are further achieved through a control methodology of a mining screen. In one embodiment, said control methodology comprises the tasks of evaluating the material screening efficiency, interpreting the screening evaluated efficiency, resulting in an efficient screening or an inefficient screening so that, if inefficient screening has been detected, perform the task of changing the screen vibration regime.

BRIEF DESCRIPTION OF DRAWINGS

The present invention will hereinafter be more thoroughly described based on an execution example displayed in the drawings. The figures show:

FIG. 14—illustrates a side view of the mining screen proposed in the present invention, indicating possible amplitudes for the screen, wherein FIG. 14(*a*) represents the scenario of activation of the rear cylinders, FIG. 14(*b*) represents the scenario in which the front and rear cylinders are retracted, and FIG. 14(*c*) represents the scenario in which the front cylinders are activated;

DETAILED DESCRIPTION OF FIGURES

Referring to figures from 1 until 17, the present invention refers to a mining screen 100, now named only screen 100. More specifically, to a screen 100 for the separation of particulate, fractional, cohesive and non-cohesive populations of materials from different size classes.

Preferably, these materials should be understood as solid materials obtained from processes and activities of mineral extraction and exploration, such as rocks and minerals in general. However, the materials may alternatively be understood as other solid elements, such as fruits, vegetables, grains, granular particles in general, among others.

Figure 1:
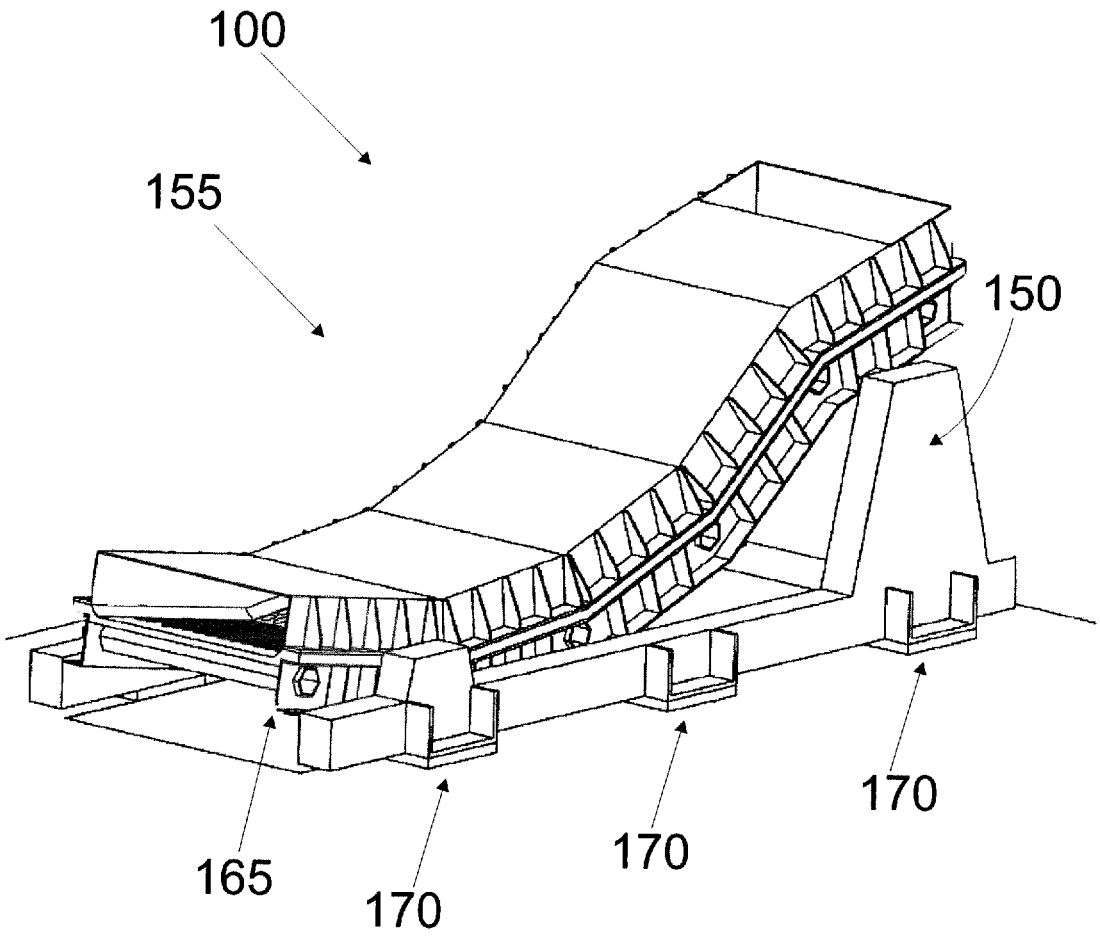
FIG. 1—is a perspective view of one arrangement of the proposed mining screen considering the teachings of the present invention.

A representation of a valid arrangement of the mining screen 1 proposed in the present invention is illustrated in FIG. 1.

The teachings proposed herein refer to a mining screen 100 composed basically of at least one propulsion element 140 associated with a screening structure 165.

Figure 4:
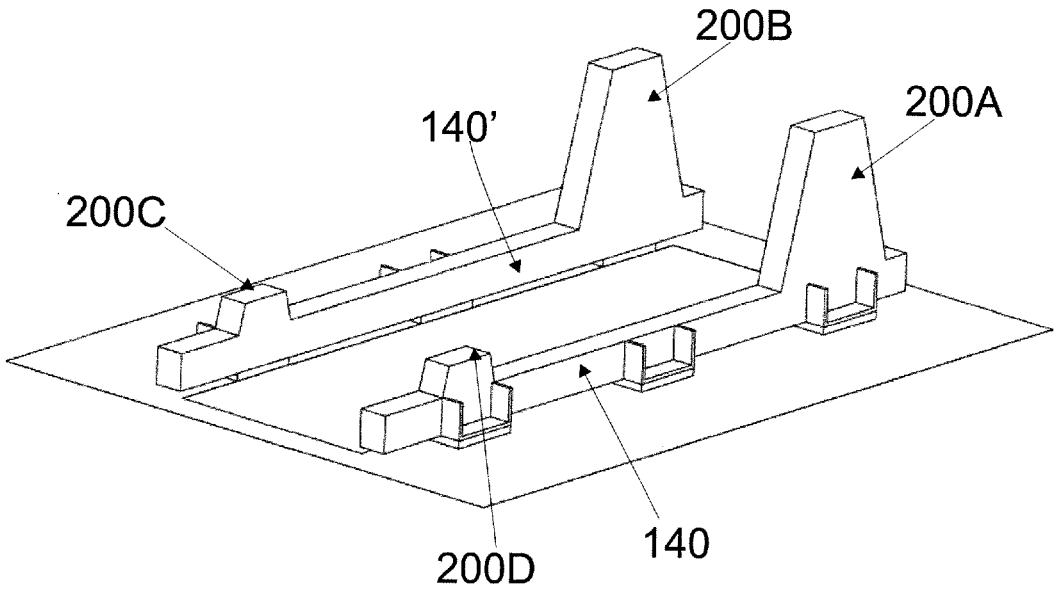
FIG. 4—is a perspective view of the propulsion element which integrates the mining screen proposed in the present invention.

FIG. 4 allows better visualization of the propulsion element 140 of the screen 100, the object of the present invention so that aforementioned propulsion element can be understood as a pair of rods 140 and 140' able to receive the screening structure 165.

The screening structure 165 of the screen 100 should be understood as the vibratory structure of the screen 100, the aforementioned structure 165 capable of describing a vibratory movement and hence carrying out the screening of the material moving through the screen 100.

Figure 2:
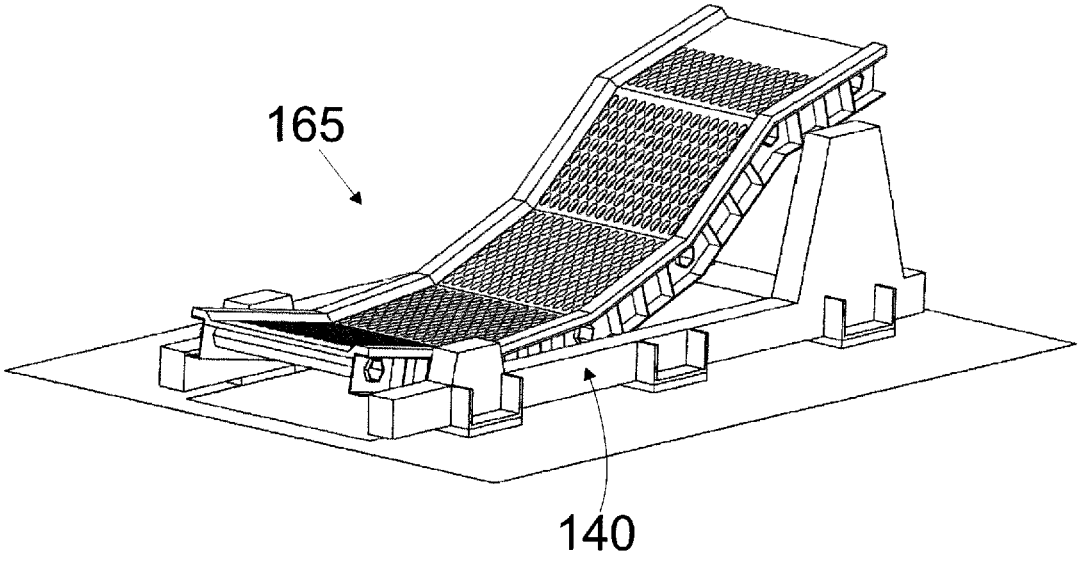
FIG. 2—is a perspective view of the mining screen shown in FIG. 1, showing the aforementioned screen without a top cover.
Figure 3:
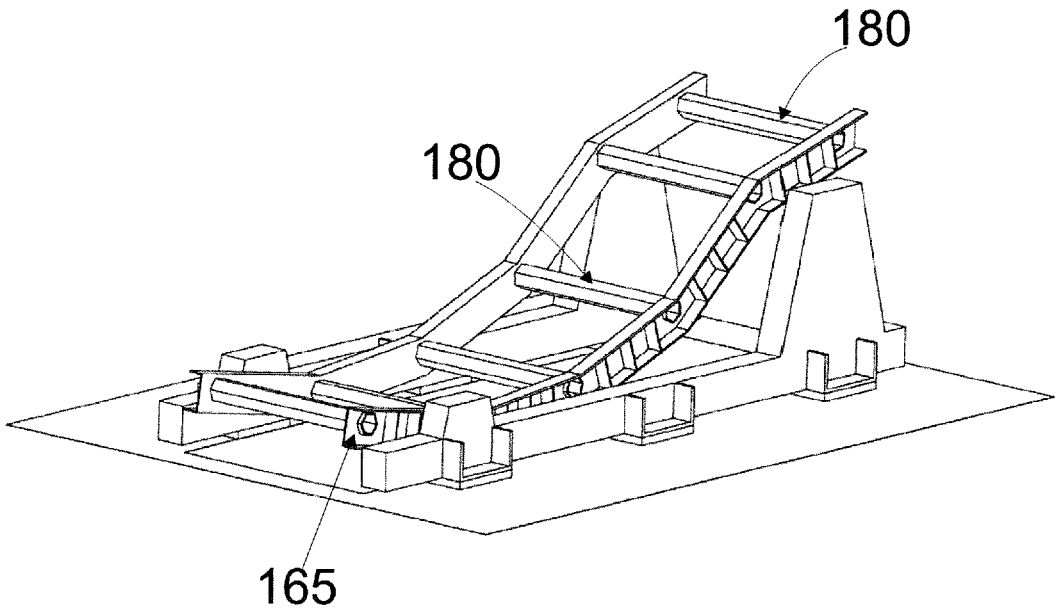
FIG. 3—is an additional perspective view of one arrangement of the proposed mining screen in the present invention.
Figure 11:
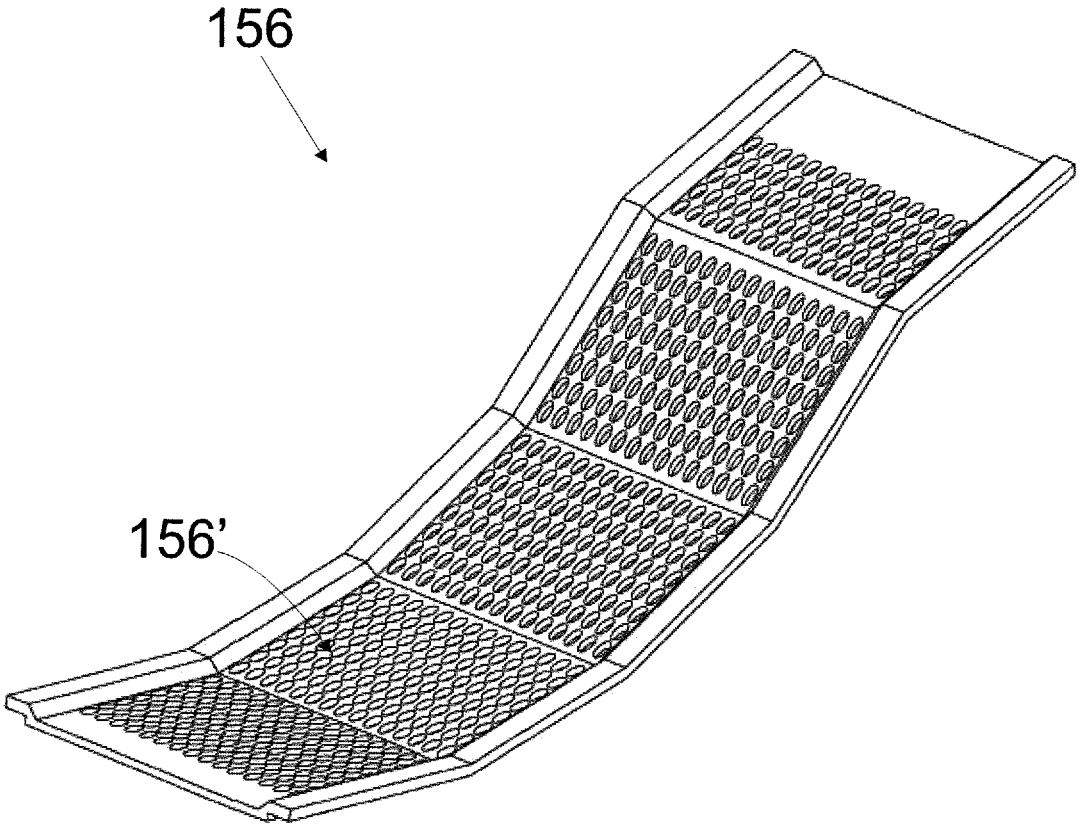
FIG. 11—is a perspective view of a panel screen suitable for use in the mining screen proposed in the present invention.
Figure 12:
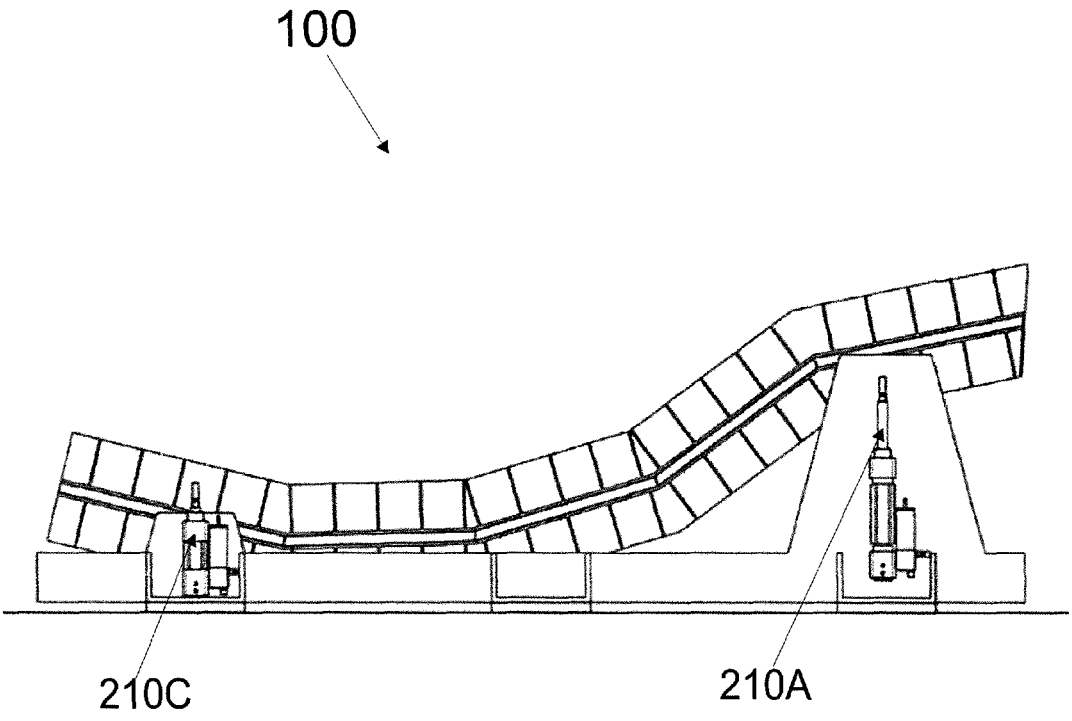
FIG. 12—is a side view of one arrangement of the mining screen proposed in the present invention.

More specifically, the screening structure 165 basically comprises a support structure 195 able to receive a screen panel 156, in such a way that the screen panel 156 is provided with a plurality of apertures 156' able to carry out the screening of the material that moves by the screen 100. FIG. 2 allows a view of the screen structure 165, which is formed by the support structure 195 (shown in FIG. 8) and by the screen panel 156 (shown in FIG. 11).

In summary, and as will be better described hereinafter, the vibratory movement of the screen 100 is performed from a mean of excitation 150, thus allowing the materials screening from mining processes.

One among the screen 100 differentials proposed in the present invention resides in its manufacturing material, so that, in this arrangement, it is proposed to manufacture the propulsion element 140 and the screening structure 165 from a first material, wherein the first material should be understood as a compound material (composite).

It should be noted that compound material (or composite) must be understood as the joining of two or more materials of different natures that complement each other and allow the obtention of new material, forming anisotropic/polytropic structures, whose characteristics and performance are better than the constituents considered separately.

In a fully valid arrangement of the present invention, the first material may be understood as carbon fiber.

In equally valid arrangements, the first material may represent at least one of the following materials as well as their possible combinations: carbon fiber, glass fiber, rohacell, kevlar, graphene, aluminum fiber or plastic fibers.

More specifically, it is proposed that the propulsion element 140 and the support structure 195 should be manufactured from a composition formed by the first material and a second material, and such that the second material may be understood as one composition comprising at least one of the following materials: glass fiber, kevlar, graphene, carbon fiber, aluminum fiber or plastic fiber.

In a valid but non-limiting way, it is proposed that the first material represents at least 85% of the manufacturing material of the propulsion element 140 and/or the support structure 195 so that the remaining 15% represents the second material (composite material).

Even more specifically, the present invention proposes that at least 90% of the propulsion element 140 and/or the support structure 195 of the panel screen 156 are manufactured from the first material.

The manufacturing of the screen 1 as proposed allows the equipment to be extremely light, yet provided with high mechanical strength, factors only achieved by manufacturing the screen 1 from the first material, as taught above.

Regarding the screen 100 practical applications, in a preferred configuration it is realized that the separation of material populations as described above takes place by the realization of a vibratory movement, this movement allowing the passage of the material to be screened through apertures 156' displayed in the screen.

The aforementioned vibratory movement is caused by the actuation of means of excitation 150 so that in the screen 100, the object of the present invention said means of excitation 150 must be stored inside the propulsion rods 140 and 140'.

Therefore, upon being excited, the means of excitation 150 will allow the screening structure 165 to perform a vibratory movement, thereby enabling the panel screen 156, provided with a plurality of apertures 156', to classify the material to be screened. The aforementioned panel screen 156, as well as its apertures 156', can be viewed from FIGS. 2 and 11.

An additional feature of the screen 1 proposed in the present invention is related to the apertures 156' of the aforementioned panel screen 156. In a valid arrangement of the present invention, it is proposed that the apertures 156' dimension become variable, hence allowing the screen 1 to be adapted according to the need of each mining process. By apertures 156' of the panel screen 156, it is to be understood as the void areas (orifices) of the panel screen such that material would be able to pass through the interior of aforementioned apertures 156'.

In short, depending on the material to be screened, the present invention proposes that apertures 156' might have the dimension altered so that by altered dimension, it is understood that the areas of the aperture 156' may vary and/or geometric shape of said apertures 156' may be altered.

This, because it has been found that the mining screens currently known in the prior art are provided with a fixed apertures dimension, however, the in-site requirement reveals that depending on the screen application, a certain shape and dimensioning of the apertures 156' become more advantageous and efficient.

In non-limiting exemplifications, there is the need to use apertures 156' of 400 mesh dimension, however, certain applications require openings 156' quadratic, e.g., 20 millimeters×20 millimeters or still 500 mm×500 mm. Still, further applications may require the use of rectangular apertures 156', e.g., 30 mm×20 mm or of oval apertures, with a maximum length of 35 mm and a maximum width of 15 mm. It is emphasized that the dimensions discussed above should not be considered as a limiting feature of the present invention.

Considering the foregoing, the present invention 1 proposes that the panel screen 156 and its apertures 156' have variable dimension, in order to this characteristic become feasible, the panel screen 156 should preferably be manufactured of the first material (such as carbon fiber, glass fiber, Kevlar fiber, aluminum, and possible combinations thereof) such that the first material acts as an insert for a polymeric material coating (such as rubber and/or polyurethane). In one arrangement, it is proposed that the polymeric material is present in a greater proportion compared to the first material so that a ratio of 80% (polymeric material) and 20% (first material) is considered valid and a ratio of 90% and 10% is considered as preferential.

Moreover, the teachings of the present invention propose that the first material insert used in panel screen 156 should also be associated with the so-called shape memory alloy (also known as smart materials), more specifically, it proposes the use of shape memory alloys capable of altering (increasing or decreasing) their dimensioning using an excitation signal.

More specifically, shape memory alloys may be understood as materials previously trained to alter their dimensioning upon receiving an excitation signal, so that, such excitation signal may be configured as at least one of an electrical signal, a piezoelectric signal and a temperature signal.

Therefore, shape memory alloys can be trained to increase or decrease their dimensioning when an electrical signal is sent to such alloys. Similarly, a piezoelectric signal can be sent indicating the need to change the dimensioning of such materials.

Similarly, the excitation signal may be configured as a specific temperature so that, if a given temperature value is reached at a given point on the panel screen 156, such value may lead to the emission of an excitation signal to the shape memory alloy, causing it to change (increase or decrease) its dimensioning.

Therefore, if during the mining process the need to change the dimensioning of the apertures 156' is identified, such excitation signal must be sent to the shape memory alloys, so that they increase or decrease their dimensioning, that is, by altering the area of the apertures 156' and/or the geometric shape of said aperture 156.

Basically, and so altering the dimensioning of the openings 156' become possible, the shape memory alloy should be associated to a sensor capable of detecting an input signal (such as the excitation signal) and an actuator capable of changing the shape, position, natural frequency or mechanical characteristics in response to the excitation signal.

Moreover, a shape memory alloy is an alloy capable of "remembering" its original shape, so that, after being deformed it is capable of returning to the previous shape by, for instance, the increase in alloy temperature or pressure.

A non-limiting exemplification of alloys capable of absorbing the teachings of the present invention are: copper-aluminum-nickel alloys, nickel-titanium alloys (NiTi) as well as alloys formed from zinc, copper, gold, and iron.

In addition, it is valid to highlight the fact that a mining process is configured as an extremely intense process and of excessive vibrations, hence, during the screening of a certain material (such as iron ore), said intensity can be such that, over time causes the panel screens apertures 156' to increase due to the frictional wear and micro damages during passage of the particle through the apertures 156'.

Therefore, by using the shape memory alloys as proposed in the present invention, upon detection that the efficiency in classifying (screening) the material is compromised (due to the increase of the apertures 156'), such excitation signal may be sent to the shape memory alloys, causing them to have their dimensioning altered. Such proposal, in addition to improving the efficiency in the screening process, increases the longevity of the screen panel 156 as well as the screen 100.

In general terms, it is proposed that the apertures 156' dimensioning may range from 0.050 mm to 100 mm (any value between such range is acceptable, including its lower and upper limits). Furthermore, the aforementioned apertures 156' may comprise the following shapes: round, rectangular, square, triangular, oval, as well as any other geometric shape known in the prior art. In summary, the apertures 156' shape should not be considered as an essential feature of the present invention, so that any known shape would be capable of absorbing the teachings proposed herein.

Figure 6:
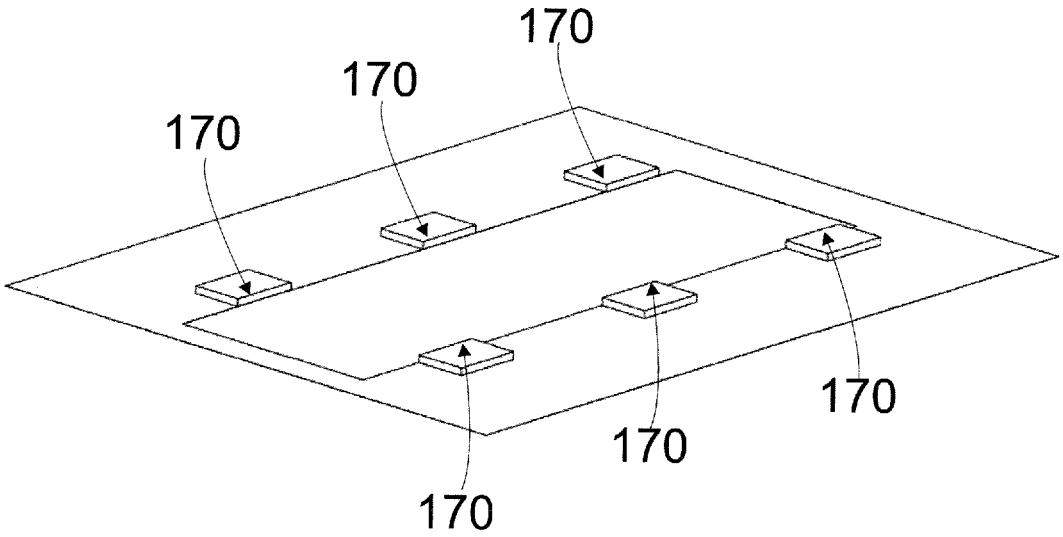
FIG. 6—is a perspective view of a support base suitable for use in the screen proposed in the present invention.

In order to efficiently operate the screen 100, this must preferably be arranged on at least one support base 170, as best shown in FIGS. 1 and 6. In this configuration, it is proposed the use of six support bases 170, which means three support bases 170 on each side of the screen 100.

Figure 5:
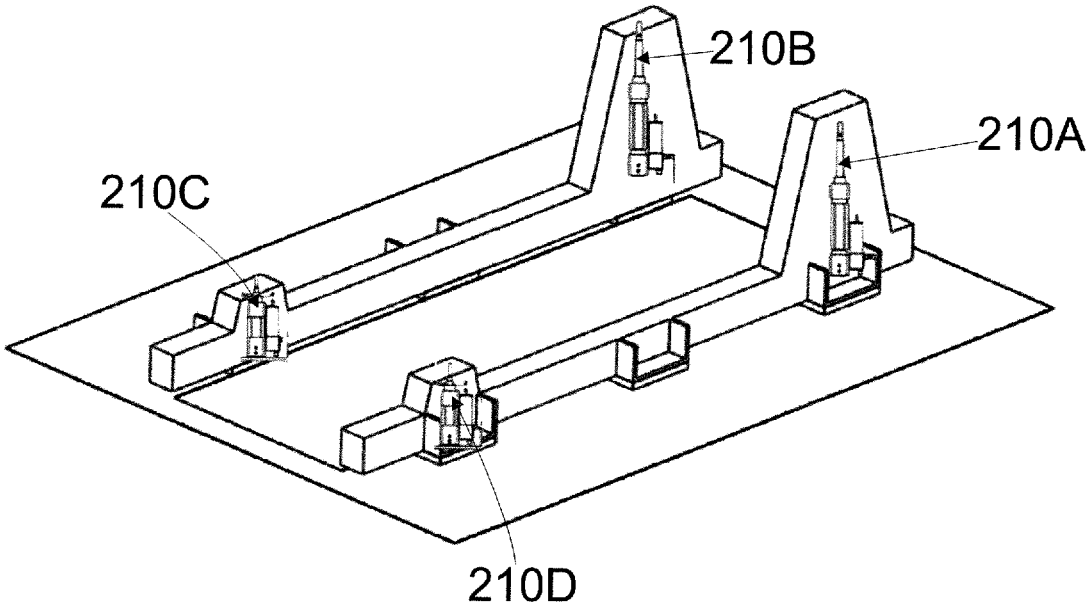
FIG. 5—is an additional perspective view of the propulsion element which integrates the mining screen proposed in the present invention, further demonstrating the hydraulic cylinders.

More specifically, the propulsion rods 140 and 140' of the screen 100 should be arranged on the support bases 170, as shown in FIGS. 1, 4 and 5. In one arrangement, the aforementioned support bases 170 may be arranged on a concrete base.

More specifically, the support base 170 is configured as an viscoelastic damping system to eliminate residual vibrations originated mainly from the means of excitation 150 when operating the screen 100, as will be better described hereinafter.

Figure 7:
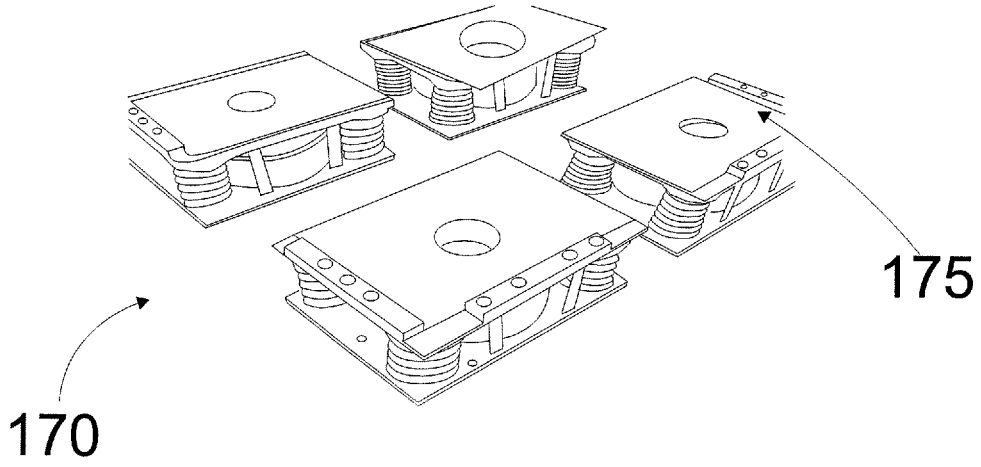
FIG. 7—is a highlighted view of the support base suitable for use in the mining screen proposed in the present invention.
Figure 7:
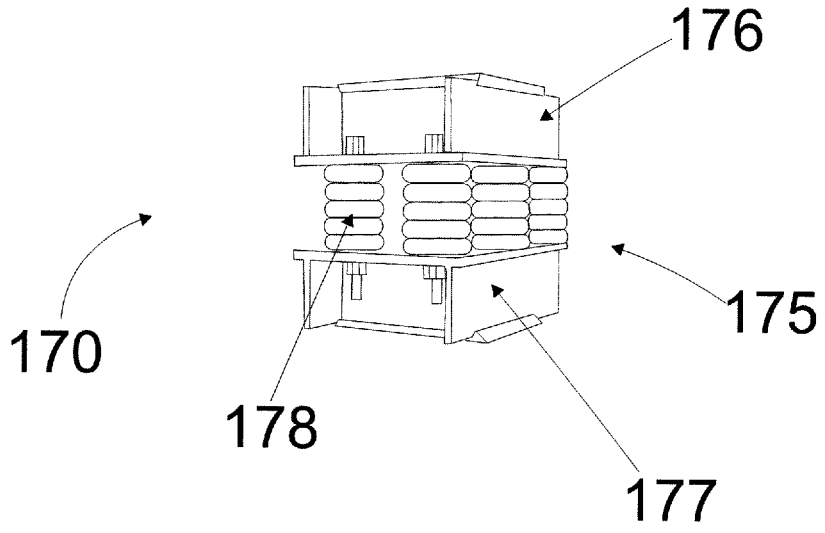

Referring specifically to FIG. 7, each support base 170 comprises at least one damper assembly 175, so that each damper assembly 175 is formed respectively by an upper and lower support portion 176 and 177, said portions associated through at least one elastic member 178.

By non-limiting mode, such viscoelastic damping systems refer to the same system used in the damping of bridges, viaducts, stadiums, among others.

The use of support bases 170 (viscoelastic damping systems) is shown very efficient in eliminating vibrations coming from extremely aggressive systems (such as mining screens 100), also eliminating the need for large civil constructions (buildings) which act as installation environments suited to withstand the weight, vibration and aggressiveness of screens 100.

As beforehand mentioned, the support bases 170 have as function absorbing the vibrations caused by the means of excitation 150. It is understood that the means of excitation 150 can be understood as the elements capable of generating/causing a vibratory movement to screen 100.

In a valid arrangement of the present invention, the means of excitation 150 are arranged in the propulsion elements 140 and 140' of the screen 100, as mainly exemplified in FIG. 5.

Regarding the propulsion elements, it is formed by independent propulsion rods 140 and 140' configured to accommodate a hydraulic actuation system 200, protecting said hydraulic system 200 against the aggressiveness of the activities performed by the screen 100. Hence, and considering this arrangement of the present invention, the means of excitation 150 may be understood as a hydraulic system 200.

Specifically, the hydraulic system 200 is arranged within the propulsion rods 140 and 140', so that, taking FIG. 4 as a reference, one should arrange the hydraulic system in accommodation portions 200A, 200B, 200C, and 200D of the propulsion rods 140 and 140'.

In order to that movement may be transmitted from the hydraulic system 200 for the screening structure 165, it is proposed that the propulsion rods 140 and 140' comprise means (such as orifices) enabling the passage of the hydraulic cylinders rods, so that the other components that integrate the hydraulic system must be arranged within the rods 140 and 140'.

Therefore, the hydraulic cylinders movement causes the movement of screening structure 165, thus enabling the classification (screening) of the material to be performed. It is hence understood that the hydraulic cylinders rods should be in contact with the screening structure 165.

For accommodation portions 200A, 200B, 200C and 200D, it should be understood as the trapezoidal areas of the propulsion rods 140 and 140', moreover, the portions 200A and 200B have a greater height relative to portions 200C and 200D, thus allowing the arrangement of panel screen 156 in inclined mode, as shown, for example, the FIGS. 1, 4, 5, and 12. Prominently, it should be noted that the aforementioned feature and relating to a greater height of the rear portion 200A and 200B relative to the front portion 200C and 200D should not be considered as a limitation of the present invention. Considering valid arrangements, the rear portions 200A and 200B and front 200C and 200D could have the same height, yet the rear portion 200A and 200B could have a lower height than the front portion 200C and 200D.

The arrangement of the hydraulic system 200 within the propulsion rods 140 and 140', results in the so-called enclosure of hydraulic system 200, therefore allowing the system 200 protection against existing hostility in a mining environment.

In one arrangement, it is proposed the utilization of four hydraulic cylinders 210A, 210B, 210C, and 210D, respectively arranged in the accommodation portions 200A, 200B, 200C, and 200D. It is consequently understood that the hydraulic cylinders 210A and 210B are arranged in a rear portion of the screen 100 and the hydraulic cylinders 210C and 210D are arranged in a front portion of the screen 100. Moreover, the front cylinders 210C and 210D must have a height lower than cylinders 210A, 210B, thereby configuring a ramp for screen 100 arrangement.

FIG. 5 illustrates a non-limiting mode of the arrangement of the hydraulic cylinders 210A, 210B, 210C and 210D in the propulsion rods 140 and 140'. It should be remarked that the teachings of the present invention propose that the hydraulic cylinders 210A, 210B, 210C, and 210D must be arranged within the propulsion rods 140 and 140', so that such rods 140 and 140' may not move due to the actuation of the cylinders 210A, 210B, 210C, and 210D.

Therefore, the rods 140 and 140' houses the components of the hydraulic system 200, so that the displacement movement of the cylinders rods 210A, 210B, 210C, and 210D is transmitted to the screening structure 165. It is understood that the rods 140 and 140' should comprise means (such as apertures or any equivalent element) to enable the rods of the rollers 210A, 210B, 210C, and 210D to contact the screen frame 165.

The present invention proposes furthermore that the actuation of the hydraulic cylinders 210A, 210B, 210C, and 210D should be realized in an independent mode, wherein, by independent mode should be understood as the possibility of movement of at least one of the cylinders 210A, 210B, 210C, and 210D.

It is understood so, that in case of interest of the screen 100 users, this can issue an activation signal only for the left front hydraulic cylinder 210D. The same would apply to the other cylinders 210A, 210B, and 210C.

Moreover, and if desired, independent activation of the hydraulic cylinders could occur in pairs, thus allowing, for instance, rear cylinders 210A and 210B to be controlled independently of the front cylinders 210C and 210D.

Similarly, it would be possible to control cylinders 210A and 210D independently of cylinders 210B and 210C. In addition, it would be possible to issue a first activation signal to only three of the hydraulic cylinders, so that the remaining cylinder would receive a second activation signal.

In one arrangement, the first activation signal could indicate the need to reduce (retract) in 3 cm and, the second activation signal could indicate the need to elevate by 1 cm.

Obviously, the control of each of the four hydraulic cylinders independently is also possible.

It is thus understood that the present invention provides independent control of at least one of the hydraulic cylinders 210A, 210B, 210C, and 210D, in any case, a valid arrangement and extremely accepted in-site shows that the rear cylinders (210A and 210B) control independently of the front cylinders (210C and 210D) control should be understood as a preferred arrangement of the teachings herein proposed.

Therefore, a first activation signal can be delivered to the cylinders 210A and 210B and a second activation signal may be issued to the cylinders 210C and 210D. Similarly, a single activation signal may be emitted to the rear cylinders (210A and 210B) while the front cylinders (210C and 210D) must remain stationary. Obviously, the reverse situation is also fully acceptable.

That is, the screen 100 user has the possibility of making any kind of movement with the cylinders 210A, 210B, 210C, and 210D.

The advantages related to the hydraulic system 200 arrangement in the propulsion rods 140 and 140' are numerous, from their complete enclosure that provides protection against hostile ores and particulates in suspension to flexibility and quick and practical disassembly of the screening structure 165, and the possibility of spacing the rods 140 and 140', increasing/decreasing the distances between them to absorb larger or narrower screens, thus achieving a unique and versatile equipment concept for different processes.

Therefore allowing that the propulsion rods 140 and 140' to be positioned at optimal positions for separate and different machines, allowing in this way to absorb various types and machine types.

In summary, the elements that integrate the hydraulic system 200 are: Hydraulic Command Unit, Hydraulic Cylinders, Hydraulic pumps, valves, hoses and pipes, control and automation systems in order to require the cylinders operation (PLCs, HMI, Special Computers).

Hereinafter described is the proposed manner for the hydraulic system 200 movements to be transmitted to the panel screen 156 of the screen 100. More specifically, it is described as a valid arrangement to associate the screen panel 156 to the mining screen 100.

Regarding the screening structure 165, this can be understood as the vibrating structure 165 of the screen 100. As demonstrated especially in FIGS. 2, 8, and 11, the screening structure 165 is basically formed by a support structure 195 and a screen panel 156.

Figure 8:
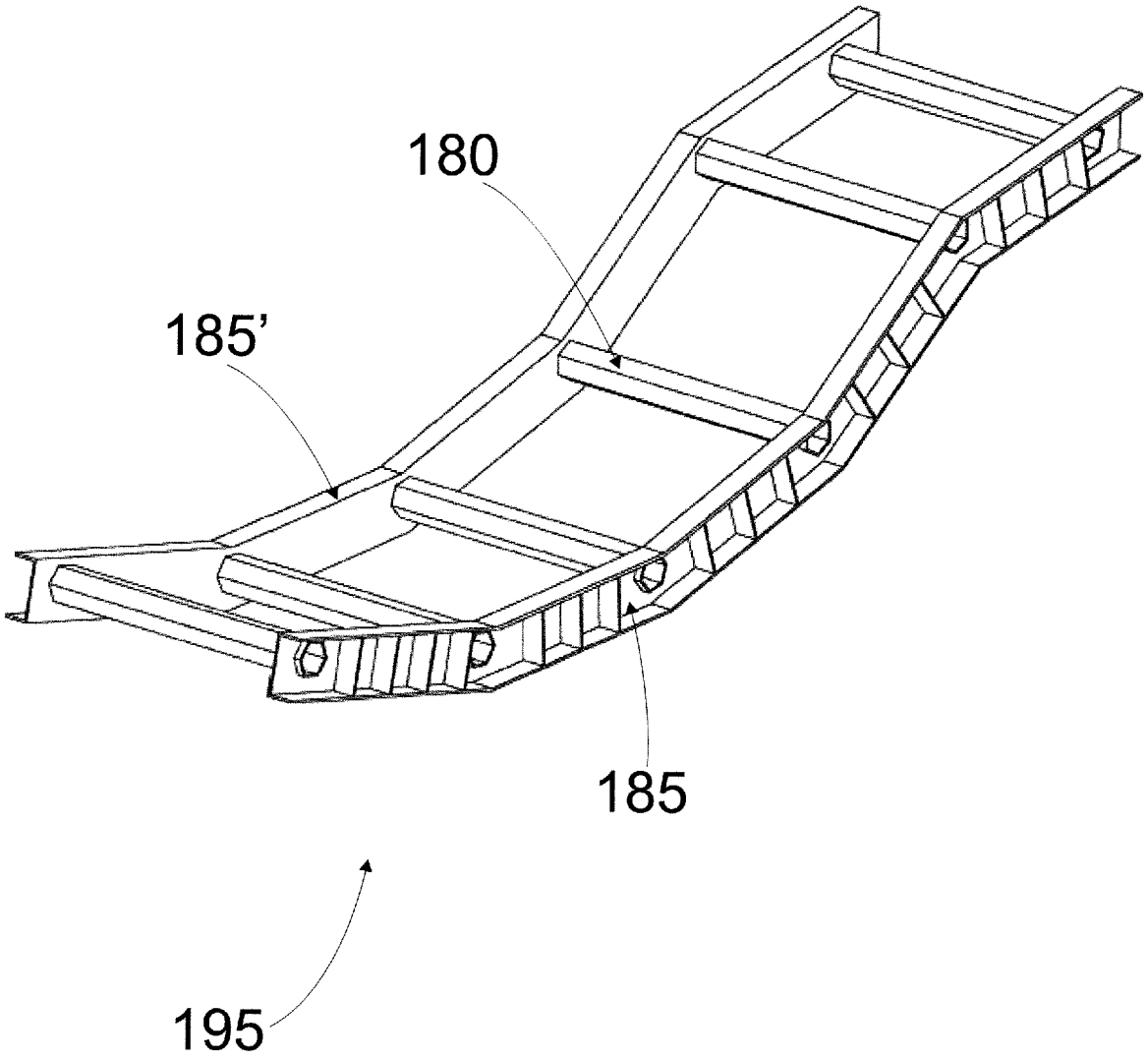
FIG. 8—is a perspective view of one arrangement of the support structure suitable for use in the mining screen proposed in the present invention.
Figure 9:
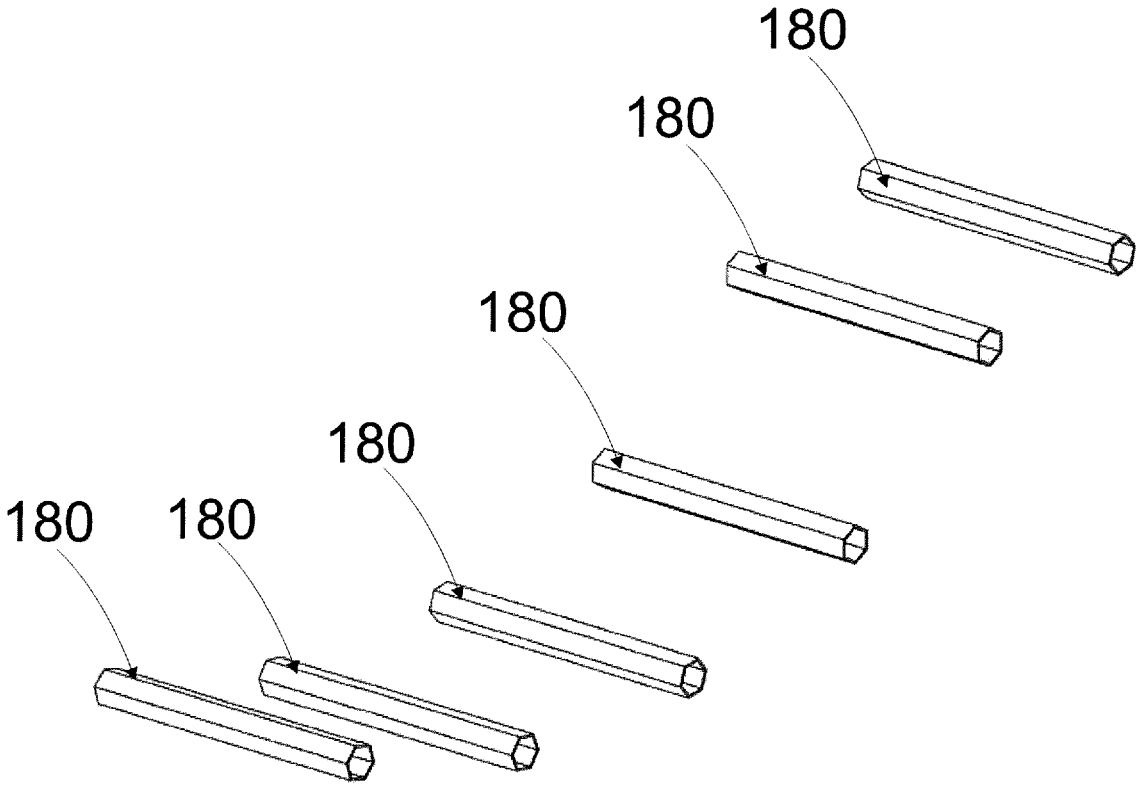
FIG. 9—is a perspective view of the crosspieces shown in FIG. 8.
Figure 10:
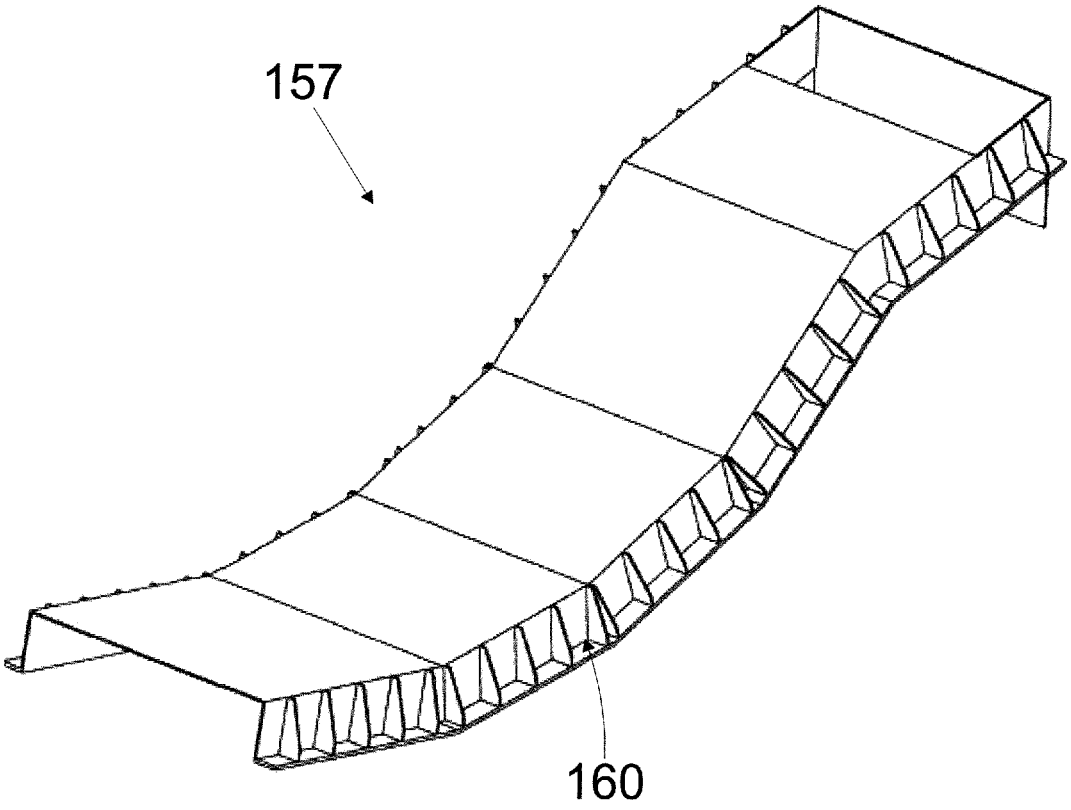
FIG. 10—is a perspective view of a top cover suitable for use in the mining screen proposed in the present invention.

The support structure 195 is best illustrated in FIG. 8, so that, from this representation, it is noted that the structure 195 is formed by at least one crosspiece 180 associated with side portions 185 and 185'. It is emphasized that the association between the support structure 195 and the propulsion element 140 occurs through a connecting link, such link should be understood as every element able to apply to support structure 195 the excitation originated from the means of excitation 150. In a non-limiting arrangement, the connecting link may be understood as an extension of at least one of the crosspieces 180 beyond the side portions 185 and 185'.

In accordance with the teachings of the present invention, it is proposed that the crosspieces 180 and the side portions 185 and 185' should be manufactured from the first material, the first material configured as a compound (composite) material. In a valid arrangement, the first material may represent at least one of the following materials as well as its possible combinations: carbon fiber, glass fiber, kevlar, graphene, rohacell, and aluminum fiber.

More specifically, the present invention teaches that the support structure 195 (crosspieces 180 and side portions 185 and 185') should be manufactured from a composition formed by the first material and a second material, so that the second material may be understood as a composition formed by at least one of the following materials: glass fiber, kevlar, graphene, rohacell, carbon fiber, and aluminum fiber.

It is also noted that the total number of crosspieces 180, used in the screen 100, is linked to the type of screen 100 desired, so that, referring to FIG. 8, it is noted that this arrangement of the present invention proposes the use of six crosspieces 180. Obviously, such an amount should not be considered as a limitation of the present invention, so that a lower or greater number of crosspieces 180 could be used.

Still referring to FIG. 8, it is proposed that the crosspieces 180 should be attached to side portions 185 and 185', so that the fixing of the crosspieces 180 to the side portions 185 and 185' occur preferably by pressure, so that said portions 185 and 185' must comprise orifices for the arrangement of the crosspieces 180. Furthermore, it is proposed that such crosspieces 180 comprise hexagonal, round, square, rectangular, or any other section able to be obtained through the crosspieces 180 manufacture considering the mentioned materials.

The attachment of the crosspieces 180 to the side portions 185 and 185' can also be performed by using conventional fasteners, such as resins and adhesives to attach composite materials. Moreover, the fastening of the crosspieces 180 could occur through specific techniques for composite materials attachment, such as one-shot, taping, among others.

Figure 13:
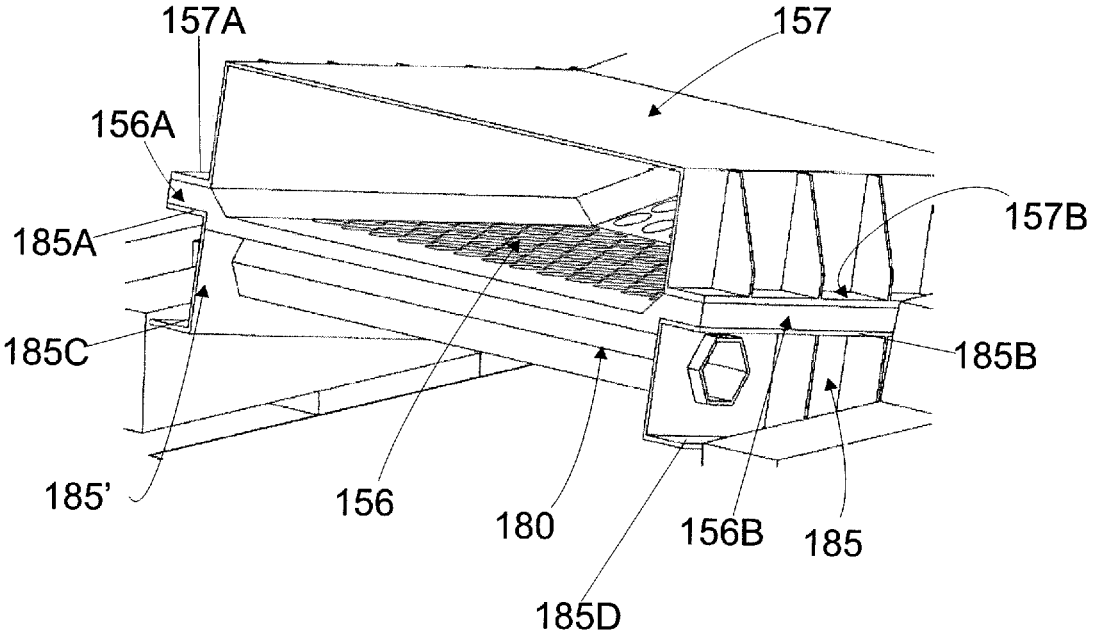
FIG. 13—is a perspective view highlighting the components attachment method of the mining screen proposed in the present invention.
Figure 15:
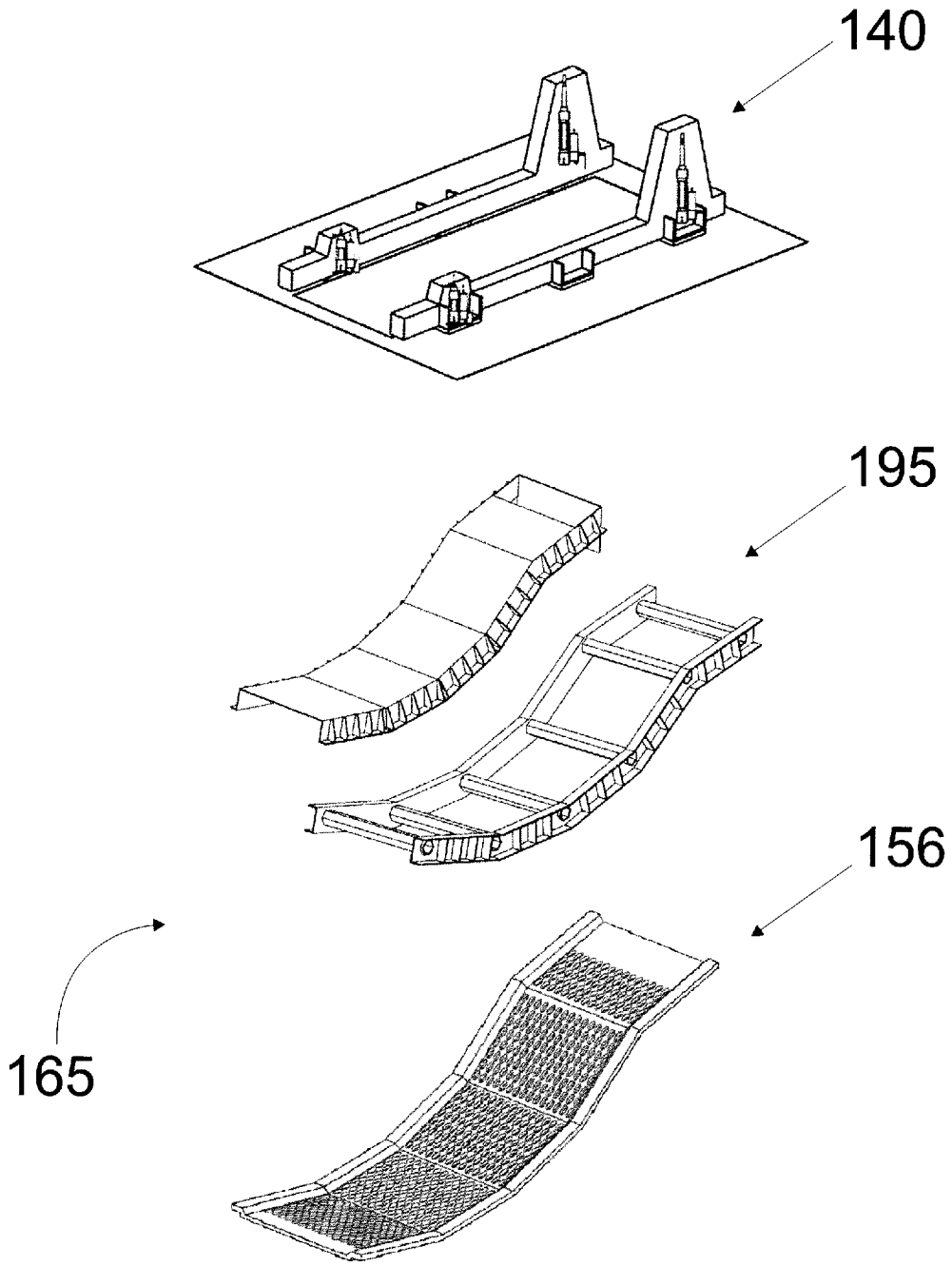
FIG. 15—is a representation highlighting some of the comprised components of the mining screen proposed in the present invention, highlighting the propulsion elements and screening structure.

FIGS. 2 and 13 allow visualization of a valid form of association between the panel screen 156 and the support structure 195 of the screen 100. In these figures, it is noted that support portions 156A and 156B of the screen panel 156 are respectively arranged on extensions 185A and 185B of the side portions 185' and 185.

The panel screen 156 support portions 156A and 156B can be understood as a slight elevation of the panel screen 156 baseline, such baseline should be understood as the baseline 156 wherein the apertures 156' are displayed.

Moreover, the extensions 185A and 185B of the side portions 185' and 185 can be understood as supporting structures for the panel screen 156 support portions 156A and 156B in such a way that, in this arrangement, such extensions 185A and 185B are configured as orthogonal extensions displayed from the main plane of the side portions 185' and 185, and such a main plane can be understood as the side portions 185' and 185 plane which receives the crosspieces 180.

Therefore, it should be noted in this invention embodiment, each of the extensions 185A and 185B start from the sides that possess the greater length of the side portions 185' and 185, more specifically, the upper side of these portions 185' and 185. Yet referring about FIG. 13, it is noted the existence of the extensions 185C and 185D, which are orthogonally displayed starting at the side portions 185' and 185 lower sides.

From FIG. 13 it is also noticed the provision of a top cover 157, such element acts as a protection for the screen panel 156 of screen 100. In a valid arrangement, the top cover 157 extensions 157A and 157B must be respectively displayed though the panel screen 156 support portions 156A and 156B.

Therefore, such extensions 157A and 157B presses not only the supporting portions 156A and 156B but also the extensions 185A and 185B.

Consequently, the arrangement and fastening of panel screen 156, top cover 157, and support structure 195 occurs as a sandwich effect, wherein the cover 157 presses the screen panel 156 and the side portions 185' and 185, as shown in FIG. 13. This configuration occurs in such a way that the interaction between the top cover 157 and the support structure 195 occurs by force, generating the fastening suitable for the screening frame 165 as well as for the screen 100 top cover 157. In order to enhance these elements fastening, high-performance industrial fastening clips industry may be used.

The combination of the crosspieces 180 to the side portions 185 and 185' enables the conformance of a solid structure, so that, after the screen 156 arrangement over the crosspieces 180 as well as the top cover 157 on the panel screen 156, it is ensured that, from the hydraulic system 200 cylinders activation, this entire assembly (crosspieces 180, lateral portions 185 and 185', panel screen 156 and top cover 157), referenced as screening structure 165, will be able to perform a vibration regime, thereby allowing the screening of the material moving though the panel screen 156.

Furthermore, the screening structure 165 should be understood as a rigid structure able to withstand the vibrating motion aggressiveness caused by hydraulic system 200, and more specifically the movement provided by hydraulic cylinders 210A, 210B, and 210C and 210D.

FIG. 14 illustrates possible vibrational regimes that can be performed by screen 100, wherein FIG. 14 (*a*) illustrates in a non-limiting manner, a scenario demonstrating cylinders 210A, and 210B extended, and the cylinders 210C and 210D retracted. Since FIG. 14 (*b*) illustrates a scenario in which the cylinders 210A, 210B, 210C, and 210D are retracted and FIG. 14 (*c*) illustrates a scenario of front cylinders 210C and 210D extended and the cylinders 210A, 210B retracted.

From the cylinders 210A, 210B, 210C, and 210D movement (upper/lower) it is possible, therefore, to change the screen 100 rear amplitude β and/or the front amplitude β1 regarding the horizontal plane screen 100 support (soil).

Therefore, the cylinders 210A, 210B, 210C, and 210D movement (upper/lower) evidently changes the rear amplitude β and front β1 of the screen 100 and also allows the variation of the front/rear amplitude, in other words, varying the cylinders position upwards and downwards, indirectly allows the screen 100 to be moved (inclined) forward and backward.

Thus, extending the cylinders 210A, 210B, and while retracting to the maximum the cylinders 210C and 210D, the material to be screened is moved forward (screen is tilted forward), however performing the opposite movement, the material is shifted backward (screen is tilted back). It is, therefore, possible to control the transport velocity of the screened material.

It is understood accordingly that the hydraulic system 200 enables the modification to at least one of amplitude, slope, and acceleration related to the vibratory motion of the screen 100. Specifically, by amplitude is understood as the dimensional displacement of the screen 100 in a specific direction, such as upward and downward and its decomposition in forward and backward movement, consequently allowing control of the transport velocity of the particle to be screened.

Nevertheless, by screen 100 acceleration it should be understood as the force with which the hydraulic system 200 moves the screen up and down, so that combining such force to a frequency and amplitude over time, the acceleration of the screen 100 happens as a result of gravity.

The vibrating motion of the screening structure 165 is held at an operating frequency $f_{op}$, in which, because of the screen 100 manufacturing materials previously commented, enables that such operation frequency $f_{op}$ to be located in frequency bands distant from the resonance frequency of the screen 100.

Exemplarily, the operation frequency $f_{op}$ is set in a range that results in an acceleration of the machine from 0 to 100 times the acceleration of gravity. In summary, combining the machine operation frequency $f_{op}$ (in Hertz) with the position variation of the hydraulic cylinders 210A, 210B, 210C, and 210D, it is possible to achieve a machine acceleration from 0 to 100 times the acceleration of gravity.

Finally, and as an additional feature of the invention, the screen 100 is also provided with a monitoring module 190 configured to provide data acquisition related to the mining screen 100. More specifically, module 190 is configured to capture at least one screening real data $D_{RP}$, and from such captured data, it enables to manipulate, for instance, the screen operating frequency $f_{op}$. Therefore, from the monitoring module 190, the present invention proposes a methodology for controlling a mining screen.

Figure 16:
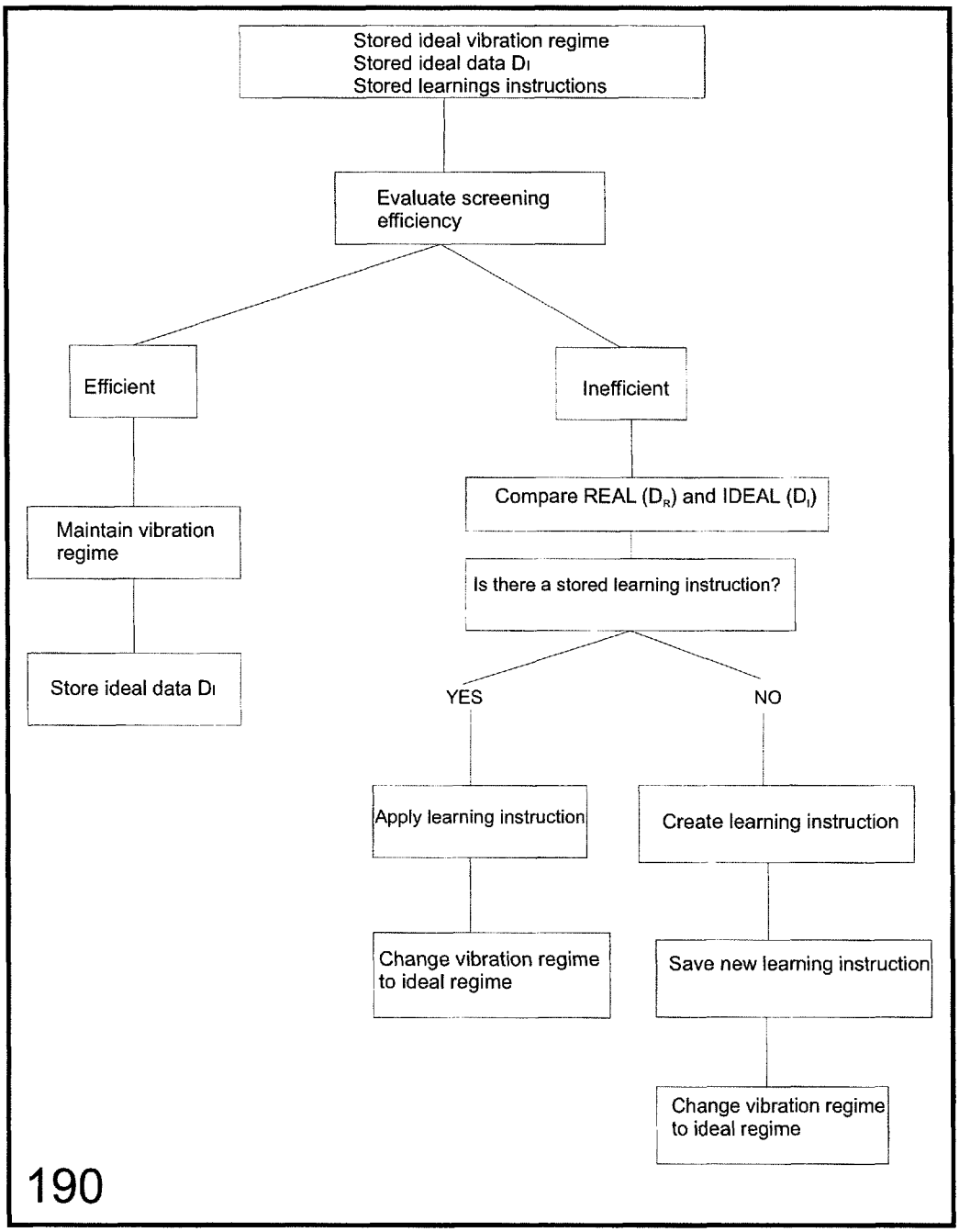
FIG. 16—shows a block representation of the monitoring module used in the mining screen proposed in the present invention.

A block illustration of the proposed control methodology is illustrated in FIG. 16.

In exemplification, it is known that during the screening process, a given material can have their properties modified (such as weight, density, moisture, temperature, etc.), it is understood that the material classification process (screening) refers to an extremely dynamic process.

However, the currently known screens in the prior art do not absorb such dynamicity through operation, that means that in the prior art, no matter how many changes occur in the material properties under classification, the screen vibration regime will not be changed.

Therefore, aiming at the constant performance of the screening process, the screen 100, object of the present invention is capable of altering at least one among the operation frequency $f_{op}$, the cylinders 210A, 210B, 210C, and 210D position of the hydraulic system 200, the apertures 156' dimension, and the amplitudes β and β1 after considering the actual data $D_{RP}$ captured and indicating possible changes in the material properties being sorted.

In other words, the screen 100 object of the present invention is able to change its vibration regime with the screening real data $D_{RP}$ obtained in the material classification.

Therefore, the screen 100, here proposed, absorbs the current dynamics in a screening process, so that any changes in material properties may result in a change in the screen 100 vibration regime.

An additional advantage linked to the monitoring module 190 utilization refers to the possibility of evaluating the screening quality (efficiency) in progress, as an example, by monitoring the amount of material that should have been screened but in fact still lies on the panel screen 156.

Hence, in an effective screening, the machine vibration regime is maintained, and the usage ideal data $D_I$ I, linked to the material in question is stored. That is, information (such as weight, density, humidity, temperature, particle size, etc.) relating to the properties of the material should be stored and forward to efficient screening, such efficient screening coupled to a machine operating regime, which can be understood as an ideal operating regime.

Nevertheless, in an inadequate screening, changing the vibration regime is possible, for instance, acting on the cylinders 210A, 210B, 210C, and 210D or changing the amplitude and actuation speed thereof.

Therefore, the module 190 is able to evaluate the reasons why the screening in progress is occurring inefficiently. In other words, it is necessary to compare the usage ideal data $D_I$ with the real screening data $D_R$, thus evaluating whether there is a variation between the properties taken as ideals $D_I$ and the indeed measured material properties $D_R$.

In a non-limiting exemplification, inefficient screening may occur due to the increase in material humidity through classification, therefore the monitoring module 190 is configured in a way to store such an instruction (learning first instruction), in other words, when the material humidity exceeds a certain limit considered as ideal, the machine vibration regime must automatically to the saved condition considered as ideal. This way, it is understood that the first learning instruction comprises a first information data indicating the variation detected between the ideal $D_I$ and real $D_R$ data. In this case, the first information data indicates that if the value of humidity exceeds a limit, the first learning instruction must be applied.

Accordingly, the monitoring module 190 enables screen 100 to a self-adapting vibration regime after considering the real screening data $D_R$ captured by the material classification. In this way, in a new material screening cycle, when a variation is detected between the ideal data $D_I$ and real data $D_R$ corresponding to the first learning instruction, the machine will automatically change its vibration regime.

If such variation does not correspond to the first learning instruction, a new learning instruction must be stored.

From such characteristics, it is possible to create a database comprising certain vibration regimens for specific materials as well as for specific ideal data $D_I$.

Similarly, several training instructions may be stored, so that if a variation in the real material properties $D_R$ is detected and refer to a previously stored instruction, the machine vibration regime is changed automatically.

In a fully satisfying arrangement, the following parameters (usage real data $D_R$) of a material could be monitored so as to evaluate the need to change the screen 100 vibration regime: material density, material humidity (either relative or apparent humidity), material granulometry, screening efficiency, material feed rate, material temperature, material weight, as well as the combination of at least one of the mentioned parameters. Similarly, these same parameters can be stored as usage ideal data $D_I$.

Additionally, data capturing methods (such as sensors) may be arranged both at the screen entry point A and in its exit point B in order to evaluate the usage real data $D_R$ previously described and the screening effectiveness. Similarly, such capturing methods may be arranged in the lower portion of the panel screen 156, thereby evaluating the material data which has already been screened. FIG. 14 (*b*) illustrates the input A and output B described previously.

In one arrangement, it is known that a material to be screened must only provide particles having a diameter less than 10 mm, i.e., only particles having a diameter lower than 10 mm must pass through the apertures 156' of the panel screen 156.

It is understood therefore that any particle having a diameter greater than 10 mm should not be screened, i.e., it should move though panel screen 156 from its starting point A to its end the point B.

Nonetheless, it can be observed at the screen 100 output point B the existence of material with a diameter smaller than 10 mm, that is, material that should have been screened, consequently requiring the need to change the screen 100 vibration regime due to the detection of an inefficient screening.

A valid possibility for the improvement of the screening process would be actuation on the front cylinder 210C and 210D, thereby reducing the material movement velocity and thus increasing the likelihood of screening.

Exemplary, a way of evaluating the aforementioned screening efficiency would be by assessing the mass balance related to the amount of material entering the screen 100 in the initial point A to the amount of material that is effectively screened and the amount of non-screened material and present at the panel screen 156 endpoint B.

For instance, it is known that for a given material under a classification, when 1 ton of the aforementioned material is entering in the initial point A, 900 kg must be screened and 100 kg must be present at the final point B. However, when evaluating the amount of present material at point B and 110 kg of material is noted, i.e., 10 kg of contamination (material which should have been screened but was not).

In a non-limiting arrangement, and as previously mentioned, the data acquisition means may be configured as sensors, cameras, spectrometry elements, as well as any other element able to capture the usage real data $D_R$ of the screening material.

Furthermore, and in a non-limiting method, it is proposed that the data acquisition methods are arranged both at the starting point A and endpoint B, but also below panel screen 156, hence allowing the capture of material data that was effectively screened.

Therefore it is described a mining screen 100 provided with the aforementioned advantages that may also be considered as a modular screen when regarding the propulsion structure 140 arrangement as well the screening structure 165, as shown in illustration 15.

Figure 17:
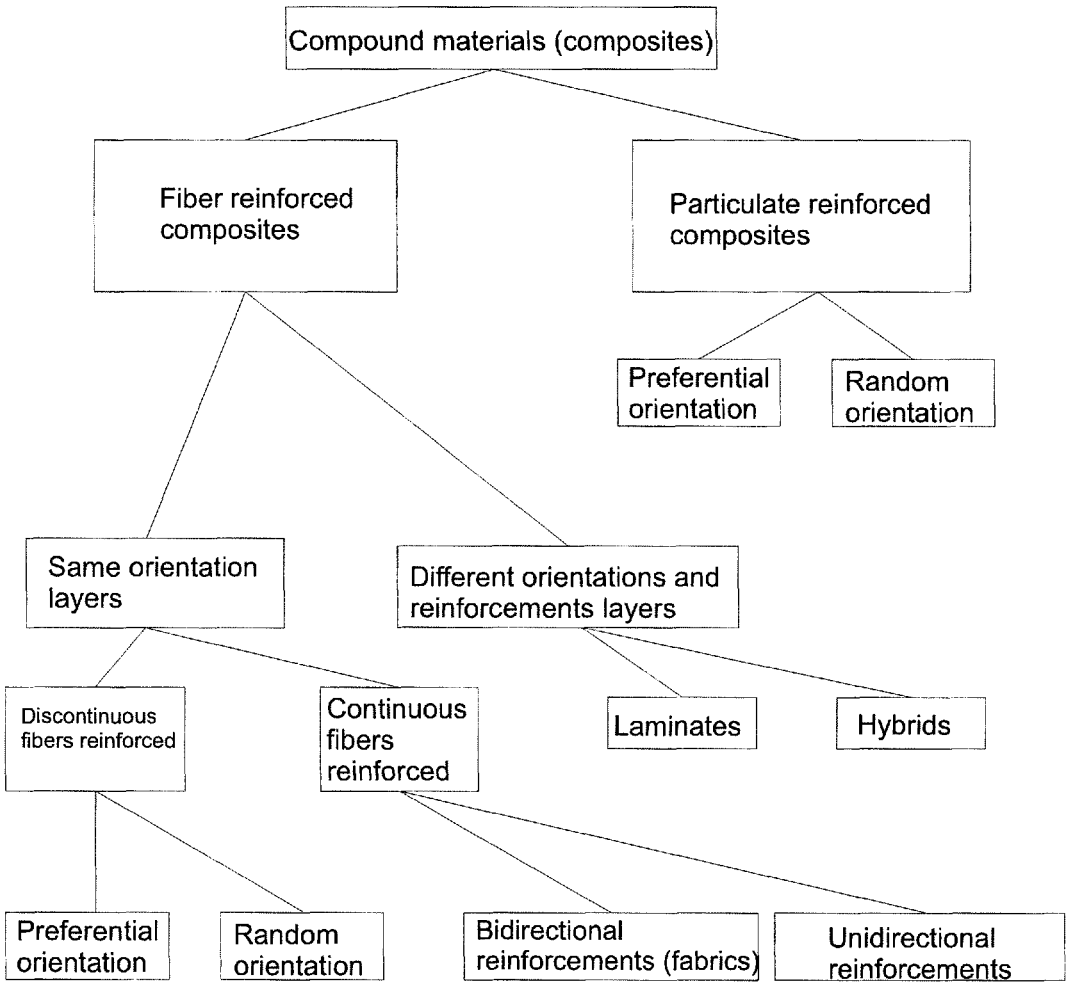
FIG. 17—illustrates a block diagram relating to possible classifications of compounds (composites) that would be able to absorb the teachings of the present invention.

Finally, it is pointed out that the teachings of the present invention are capable of absorbing the use of compound materials (composites) of any kind, whether they are fiber reinforced or particulate reinforced as well as their specifications. In this regard, FIG. 17 shows a block diagram relating to the classification of compound materials (or composites) which would be able to absorb the teachings of the present invention.

Similarly, the teachings of the present invention may consider the application of compounds (composite) laminates, i.e., the ones comprising two or more layers of different materials (such as the first material and the second material) solidary with each other. The present invention allows the production of laminates consisting of layers with unidirectional, interlaced fibers, as well as the combination between them.

Furthermore, the teachings here offered can consider the so-called sandwich composite, this comprising a core layer surrounded by outer laminated layers. It is worth highlighting that the present invention is able to utilize any type of sandwich composite already known in the prior art, such as those provided with a honeycomb core, corrugated core, solid core, among others.

In addition, the vibratory movement able to be carried out by the screen 100 may be understood as at least one of a linear, circular and elliptical movement, and may also be a combination of these movements.

Moreover, the reference to means of excitation 150 configured as a hydraulic system 200 should not pose a limitation of the present invention, so that in the fully valid arrangements the means of excitation 150 could be configured as means of pneumatic, electromagnetic, as well as combustion excitation.

Furthermore, the present invention describes a panel screen 156 for mining, so that this panel screen is provided with the previously described characteristics.

Similarly, a mining system, which makes use of the screen object of the present invention is described, as well as a mining system comprising the described screen panel.

Furthermore, the reference to the screen vibration regime represents a vibratory motion performance of the screening structure 165, in which the vibrational motion performance establishes at least one of the following vibration parameters: a rear (β) and front (β1) amplitude controlled through the actuation of the cylinders 210A, 210B, 210C, and 210D, an operating frequency ($f_{op}$) of the screen (100), a dimensioning of the apertures (156'), a screen inclination, a speed of material under classification displacement, and an acceleration related to the actuation of the cylinders 210A, 210B, 210C, and 210D.

Finally, the screen 100 illustrated in FIG. 1 should not be considered as a limiting arrangement of the teachings of the present invention, so that a plurality of screens could be formed considering the scope of protection of the claims defined herein. In one example, the present invention enables the conforming of a screen 100 comprising two or more support structures 195, in such a way that a valid possibility would be the arrangement of such structures 195 one over the other and using, for instance, only a cover 157.

Consequently, describing an example of preferred arrangement, it should be understood that the scope of the present invention encompasses other possible variations, limited only by the level of the appended claims, there included possible equivalents.

The invention claimed is:

1. A mining screen comprising at least one propulsion element, the at least one propulsion element receiving at least one screening structure, wherein the mining screen is able to perform at least one vibration regime due a means of excitation, wherein the vibration regime promotes the screening of a material moving through the mining screen, wherein:

the screening structure comprises at least one panel screen provided with a plurality of apertures capable of screening the material moving through the mining screen;

the means of excitation are arranged in the at least one propulsion element;

the at least one propulsion element and the panel screen are manufactured from a first material, the first material comprising a composite material;

wherein the apertures of the panel screen are of varying dimension, wherein each aperture defines an area for the passage of the material, so that the areas of the apertures of the panel screen are altered due an excitation signal, the excitation signal configured as at least one of an electrical signal, a piezoelectric signal and a temperature signal;

wherein the panel screen is formed by at least the first material and a polymeric material, so that the first material acts as an insert to a coating of the polymeric material, wherein at least 80% of the panel screen is manufactured from the polymeric material;

the panel screen further comprising a shape memory alloy associated with the first material that alters the area of the apertures of the panel screen in response to a change in shape of the shape memory alloy when the excitation signal is connected to the shape memory alloy.

2. The mining screen according to claim 1, wherein the screening structure comprises at least one support structure associated with the panel screen, wherein the support structure is associated with the at least one propulsion element.

3. The mining screen according to claim 2, wherein the first material comprises at least one of: carbon fiber, glass fiber, kevlar, graphene, rohacell, aluminum fiber.

4. The mining screen according to claim 3, wherein the at least one propulsion element and the support structure of the panel screen are manufactured from a composition formed by the first material and a second material, wherein the second material comprises a composition formed by at least one of: glass fiber, kevlar, graphene, rohacell, carbon fiber, and aluminum fiber.

5. The mining screen according to claim 4, wherein at least 90% of at least one of the at least one propulsion element and the support structure of the panel screen are manufactured from the first material.

6. The mining screen according to claim 1, wherein the dimension of the apertures of the panel screen ranges from 0.050 mm to 100 mm.

7. The mining screen according to claim 1, wherein the at least one propulsion element comprises a pair of propulsion rods, wherein the propulsion rods are capable of accommodating the mean of excitation, wherein the mean of excitation is configured as at least one among a hydraulic, electromechanical, pneumatic, and magnetic propulsion system.

8. The mining screen according to claim 7, wherein the means of excitation is configured as a hydraulic system, wherein the propulsion rods comprise the accommodation portions of the hydraulic cylinders, wherein each accommodation portion comprises a hydraulic cylinder.

9. The mining screen according to claim 8, wherein the accommodation portions configure a rear accommodation portion and a front accommodation portion, wherein the rear accommodation portion has a greater height than the front accommodation portion.

10. The mining screen according to claim 9, wherein the hydraulic cylinders are grouped in rear cylinders and front cylinders wherein the activation of the rear cylinders is independent of the activation of the front cylinders.

11. The mining screen according to claim 10, wherein the screening structure further comprises a cover associated to a panel screen, wherein the panel screen is displayed between the cover and the crosspieces of the support structure, wherein the extensions of the cover press the support portions of the panel screen as well as the extensions of the side portions.

12. The mining screen according to claim 11, wherein the vibration regime of the screen represents the realization of a vibratory motion of the screening structure, wherein the realization of the vibratory motion comprises at least one among the following parameters: a rear amplitude (β), a front amplitude (β1), an operating frequency (fop) of the screen and a dimensioning of the apertures.

13. The mining screen according to claim 12, wherein the mining screen comprises a monitoring module configured to acquire at least one real screening data (DR), so that from the captured real screening data (DR) the mining screen is able to change its vibration regime.

14. A panel screen, wherein the panel screen is able to perform at least one vibration regime therefore promoting a material screening through a plurality of apertures arranged in the panel screen, wherein the panel screen is formed by at least a first material, a polymeric material, and a shape memory alloy so that the first material acts as an insert to a coating of the polymeric material, wherein at least 80% of the panel screen is manufactured from the polymeric material, wherein each aperture defines an area for the passage of the material, wherein the respective area of each of the apertures is altered due an excitation signal that is sent to the shape memory alloy that causes a change in shape of the shape memory alloy.

* * * * *